US009298141B2

(12) United States Patent
Itoh

(10) Patent No.: US 9,298,141 B2
(45) Date of Patent: Mar. 29, 2016

(54) IMAGE HEATING DEVICE

(71) Applicant: CANON KABUSHIKI KAISHA, Tokyo (JP)

(72) Inventor: Masatoshi Itoh, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/275,606

(22) Filed: May 12, 2014

(65) Prior Publication Data

US 2014/0341599 A1 Nov. 20, 2014

(30) Foreign Application Priority Data

May 14, 2013 (JP) ..... 2013-102396

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

2012/0155905 A1* 6/2012 Ogura ..... 399/68

FOREIGN PATENT DOCUMENTS

JP 2005-195640 A 7/2005
JP 4208772 B2 1/2009
JP 2011-095314 A 5/2011

* cited by examiner

*Primary Examiner* — Clayton E Laballe
*Assistant Examiner* — Noam Reisner
(74) *Attorney, Agent, or Firm* — Canon USA, Inc. IP Division

(57) ABSTRACT

An image heating device includes first and second heating elements, a temperature detection element, and an electric power controller. The electric power controller controls electric power to be supplied to the both heating elements for each control cycle corresponding to a period including a plurality of consecutive half cycles of alternate current per a detected temperature. The electric power controller controls electric power such that a current having a waveform including first half cycles and a second half cycle is supplied to both heating elements. The electric power controller sets a first control pattern such that the first and second half cycles overlap with each other in the half cycles of same phases in supplied alternate current and sets a second control pattern such that the first half cycles overlap with each other and the second half cycles overlap with each other in the half cycles of the same phases.

16 Claims, 18 Drawing Sheets

FIG. 8A

FIRST CONTROL PATTERN: (Px ≥ 51 AND Py ≥ 51) OR (Px ≤ 50 AND Py ≤ 50)

| | FIRST HEATING ELEMENT TABLE | | | | | | | |
|---|---|---|---|---|---|---|---|---|
| Px | M1P | M1N | M2P | M2N | M3P | M3N | M4P | M4N |
| 100% | 100 | 100 | 100 | 100 | 100 | 100 | 100 | 100 |
| 90% | 100 | 80 | 80 | 100 | 100 | 80 | 80 | 100 |
| 80% | 100 | 60 | 60 | 100 | 100 | 60 | 60 | 100 |
| 70% | 100 | 40 | 40 | 100 | 100 | 40 | 40 | 100 |
| 60% | 100 | 20 | 20 | 100 | 100 | 20 | 20 | 100 |
| 50% | 0 | 100 | 100 | 0 | 0 | 100 | 100 | 0 |
| 40% | 0 | 80 | 80 | 0 | 0 | 80 | 80 | 0 |
| 30% | 0 | 60 | 60 | 0 | 0 | 60 | 60 | 0 |
| 20% | 0 | 40 | 40 | 0 | 0 | 40 | 40 | 0 |
| 10% | 0 | 20 | 20 | 0 | 0 | 20 | 20 | 0 |
| 0% | 0 | 0 | 0 | 0 | 0 | 0 | 0 | 0 |

| | SECOND HEATING ELEMENT TABLE | | | | | | | |
|---|---|---|---|---|---|---|---|---|
| Py | S1P | S1N | S2P | S2N | S3P | S3N | S4P | S4N |
| 100% | 100 | 100 | 100 | 100 | 100 | 100 | 100 | 100 |
| 90% | 80 | 100 | 100 | 80 | 80 | 100 | 100 | 80 |
| 80% | 60 | 100 | 100 | 60 | 60 | 100 | 100 | 60 |
| 70% | 40 | 100 | 100 | 40 | 40 | 100 | 100 | 40 |
| 60% | 20 | 100 | 100 | 20 | 20 | 100 | 100 | 20 |
| 50% | 100 | 0 | 0 | 100 | 100 | 0 | 0 | 100 |
| 40% | 80 | 0 | 0 | 80 | 80 | 0 | 0 | 80 |
| 30% | 60 | 0 | 0 | 60 | 60 | 0 | 0 | 60 |
| 20% | 40 | 0 | 0 | 40 | 40 | 0 | 0 | 40 |
| 10% | 20 | 0 | 0 | 20 | 20 | 0 | 0 | 20 |
| 0% | 0 | 0 | 0 | 0 | 0 | 0 | 0 | 0 |

FIG. 8B

SECOND CONTROL PATTERN: (Px ≥ 51 AND Py ≤ 50) OR (Px ≤ 50 AND Py ≥ 51)

| | FIRST HEATING ELEMENT TABLE | | | | | | | |
|---|---|---|---|---|---|---|---|---|
| Px | M1P | M1N | M2P | M2N | M3P | M3N | M4P | M4N |
| 100% | 100 | 100 | 100 | 100 | 100 | 100 | 100 | 100 |
| 90% | 100 | 80 | 80 | 100 | 100 | 80 | 80 | 100 |
| 80% | 100 | 60 | 60 | 100 | 100 | 60 | 60 | 100 |
| 70% | 100 | 40 | 40 | 100 | 100 | 40 | 40 | 100 |
| 60% | 100 | 20 | 20 | 100 | 100 | 20 | 20 | 100 |
| 50% | 100 | 0 | 0 | 100 | 100 | 0 | 0 | 100 |
| 40% | 80 | 0 | 0 | 80 | 80 | 0 | 0 | 80 |
| 30% | 60 | 0 | 0 | 60 | 60 | 0 | 0 | 60 |
| 20% | 40 | 0 | 0 | 40 | 40 | 0 | 0 | 40 |
| 10% | 20 | 0 | 0 | 20 | 20 | 0 | 0 | 20 |
| 0% | 0 | 0 | 0 | 0 | 0 | 0 | 0 | 0 |

| | SECOND HEATING ELEMENT TABLE | | | | | | | |
|---|---|---|---|---|---|---|---|---|
| Py | S1P | S1N | S2P | S2N | S3P | S3N | S4P | S4N |
| 100% | 100 | 100 | 100 | 100 | 100 | 100 | 100 | 100 |
| 90% | 80 | 100 | 100 | 80 | 80 | 100 | 100 | 80 |
| 80% | 60 | 100 | 100 | 60 | 60 | 100 | 100 | 60 |
| 70% | 40 | 100 | 100 | 40 | 40 | 100 | 100 | 40 |
| 60% | 20 | 100 | 100 | 20 | 20 | 100 | 100 | 20 |
| 50% | 0 | 100 | 100 | 0 | 0 | 100 | 100 | 0 |
| 40% | 0 | 80 | 80 | 0 | 0 | 80 | 80 | 0 |
| 30% | 0 | 60 | 60 | 0 | 0 | 60 | 60 | 0 |
| 20% | 0 | 40 | 40 | 0 | 0 | 40 | 40 | 0 |
| 10% | 0 | 20 | 20 | 0 | 0 | 20 | 20 | 0 |
| 0% | 0 | 0 | 0 | 0 | 0 | 0 | 0 | 0 |

IMAGE HEATING DEVICE

BACKGROUND OF THE INVENTION

1. Field of the Invention

The present invention relates to an image heating device suitably used as a fixing device included in an image forming apparatus employing an electrophotography recording technique.

2. Description of the Related Art

A fixing device included in an image forming apparatus employing an electrophotography recording technique generally includes a heater. The heater is connected to an AC power source through a switching element such as a triac, and electric power is supplied from the AC power source so that the heater generates heat.

When the heater (a heating element) is controlled, a harmonic current and a flicker are required to be suppressed. Japanese Patent Laid-Open Nos. 2005-195640 and 2011-95314 disclose methods for suppressing generation of a harmonic current and a flicker in a fixing device including a plurality of heaters. Specifically, a waveform in which a first half cycle in which current is supplied or not supplied in entire half cycles of alternate current and a second half cycle in which current is supplied in portions of half cycles of the alternate current are mixed is applied to two heaters which may be independently driven. Furthermore, the alternate current supplied to one of the heaters and the alternate current supplied to the other of the heaters are controlled such that the first and second half cycles overlap with each other in half cycles of the same phases of the alternate current supplied to the two heaters. This control is advantageous since synthesized current supplied to the two heaters becomes similar to a sine wave, and therefore, a power factor is improved.

In some fixing devices including a plurality of heaters, for example, a fixing device disclosed in Japanese Patent No. 4208772, a power supply ratio between heaters is changed in accordance with a size of a recording material and different heat generation distributions are set.

Here, when the control methods disclosed in Japanese Patent Laid-open Nos. 2005-195640 and 2011-95314 are employed in an apparatus which changes a power supply ratio between heaters in accordance with a size of a recording material, such as the apparatus disclosed in Japanese Patent No. 4208772, the following problem arises. That is, when a recording material of a small size is subjected to a fixing process, electric power to be supplied to one of heaters is required to be reduced in order to suppress a heat generation amount in a region in which the recording material does not pass. However, it is found that electric power is concentrated on certain half cycles of an AC waveform and a flicker is further generated.

SUMMARY OF THE INVENTION

The present invention provides an image heating device which supports a case where improvement of a power factor is preferentially performed or a case where suppression of a flicker is preferentially performed. An electric power controller may set a first control pattern in which electric power is controlled such that first half cycles in which current is supplied or not supplied in entire half cycles of alternate current and second half cycles in which current is supplied portions of portions of half cycles of alternate current overlap with each other in half cycles of the same phases in the alternate current supplied to the first heating element and the alternate current supplied to the second heating element and a second control pattern in which electric power is controlled such that the first half cycles overlap with each other and the second half cycles overlap with each other in the half cycles of the same phases.

According to an aspect of the present invention, the image heating device includes a first heating element, a second heating element configured to be driven independently from the first heating element, a temperature detection element configured to detect a temperature, and an electric power controller configured to control electric power to be supplied to the first and second heating elements for each control cycle corresponding to a period including a plurality of consecutive half cycles of alternate current in accordance with a temperature detected by the temperature detection element. The electric power controller controls electric power such that a current having a waveform including first half cycles, in which current is supplied or not supplied in entire half cycles of alternate current, and a second half cycle, in which current is supplied to portions of the half cycles of alternate current in a mixed manner, is supplied to both the first and second heating elements. The electric power controller sets a first control pattern in which electric power is controlled such that the first and second half cycles overlap with each other in the half cycles of the same phases in the alternate current supplied to the first heating element and the alternate current supplied to the second heating element and sets a second control pattern in which electric power is controlled such that the first half cycles overlap with each other and the second half cycles overlap with each other in the half cycles of the same phases.

Further features of the present invention will become apparent from the following description of exemplary embodiments with reference to the attached drawings.

BRIEF DESCRIPTION OF THE DRAWINGS

FIGS. 8A and 8B are diagrams illustrating control tables of first and second heating elements.

DESCRIPTION OF THE EMBODIMENTS

Embodiments of the present invention will be described in detail hereinafter with reference to the accompanying drawings. Here, sizes, materials, and shapes of components and relative arrangements of the components described in the embodiments may be appropriately modified in accordance with configurations and various conditions of an apparatus to which the present invention is applied. Specifically, the scope of the present invention is not limited to the embodiments below.

First Embodiment

Figure 1:
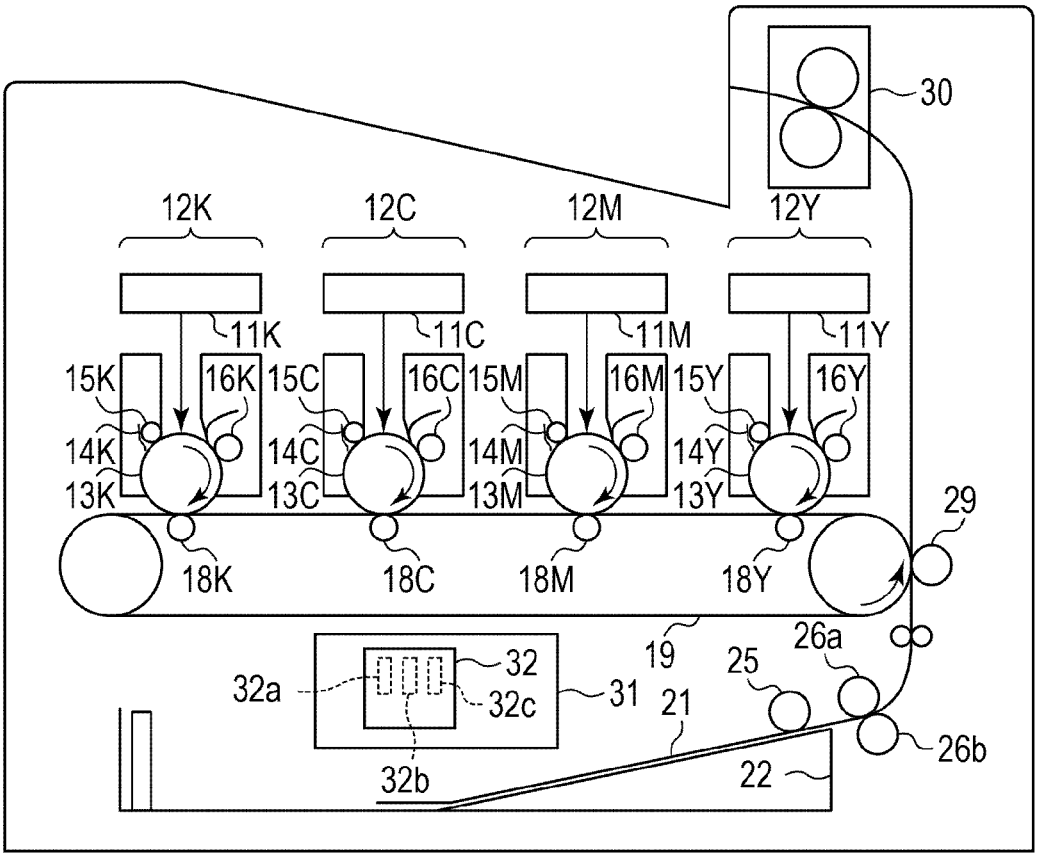
FIG. 1 is a sectional view illustrating an image forming apparatus.

FIG. 1 is a diagram illustrating a configuration of a tandem type color image forming apparatus including a fixing device serving as an image heating device. The image forming apparatus outputs a full-color image by superimposing toners of four colors including yellow (Y), magenta (M), cyan (C), and black (K). The apparatus includes four image forming units (12Y, 12M, 12C, and 12K). The image forming units 12Y to 12K include photosensitive drums 13Y to 13K, charging rollers 15Y to 15K, laser scanners 11Y to 11K, developing rollers 16Y to 16K, primary transfer rollers 18Y to 18K, and cleaners 14Y to 14K, respectively. Furthermore, an intermediate transfer belt 19 is disposed between the photosensitive drums 13Y to 13K and the primary transfer rollers 18Y to 18K of the respective colors. A secondary transfer roller 29 is used to transfer a full-color toner image superimposed on the intermediate transfer belt 19 on a recording material. A sheet (a recording material) accommodated in a cassette 22 is fed by a sheet feeding roller 25 and separated rollers 26*a* and 26*b*, and receives a toner image transferred from the intermediate transfer belt 19 by the secondary transfer roller 29. Thereafter, the sheet is subjected to a fixing process performed by a fixing device 30 and is output from the apparatus. Since general processes of image forming are used, descriptions thereof are omitted.

A controller 31 (including an electric power controller) of the image forming apparatus includes a CPU (Central Processing Unit) 32 including a ROM 32*a*, a RAM 32*b*, and a timer 32*c*, various input/output control circuits (not illustrated), and the like.

Figure 2B:
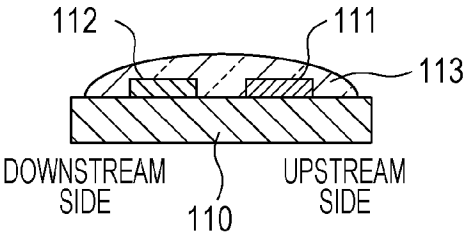
FIGS. 2A to 2C are diagrams illustrating a configuration of a fixing device.
Figure 2A:
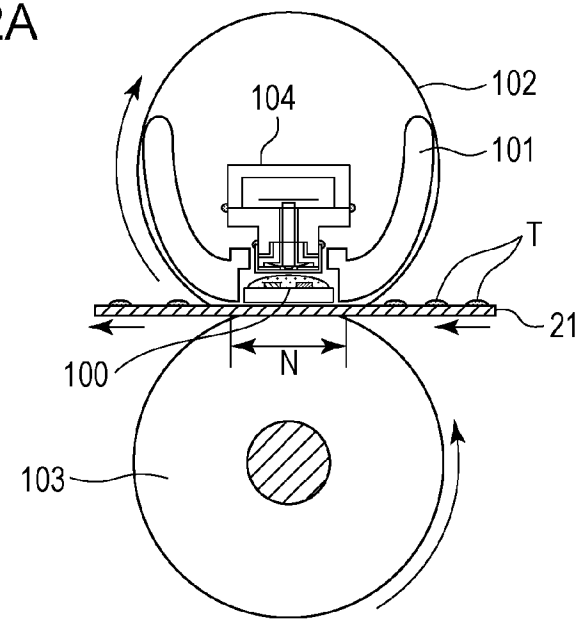

FIG. 2A is a sectional view illustrating the fixing device (the image heating device) 30. In the fixing device 30, an endless belt is driven by a backup roller. A heater 100 is in contact with an inner surface of an endless belt 102. A heat holder 101 holds the heater 100. A backup roller 103 forms a fixing nip portion N with the heater 100 through the endless belt 102. A thermal switch (a protection element) 104 operates when temperature of the heater 100 abnormally rises.

The backup roller 103 is driven in a direction indicated by an arrow mark illustrated in FIG. 2A by a motor not illustrated. In accordance with rotation of the backup roller 103, the endless belt 102 rotates. A sheet 21 which bears an unfixed toner image T is pinched and conveyed by the fixing nip portion N and subjected to a fixing process by heat generated by the heater 100 through the endless belt 102.

FIG. 2B is an enlarged sectional view of the heater 100. The heater 100 includes a substrate 110 of ceramic formed by SiC, AlN, $Al_2O_3$, or the like and first and second heating elements 111 and 112 which are formed on the ceramic substrate 110. The two heating elements 111 and 112 are protected by a protective layer 113.

Figure 2C:
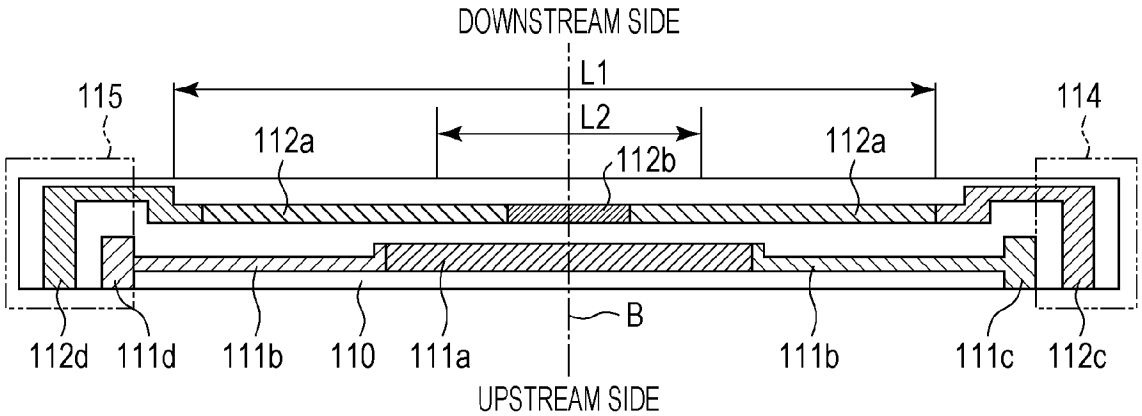

FIG. 2C is a plan view of the heater 100. The first heating element 111 includes a heating section 111*a*, electrodes 111*c* and 111*d*, and conductive sections 111*b* which connect the heating section 111*a* to the electrodes 111*c* and 111*d*. The heating section 111*a* generates heat when electric power is supplied through the electrodes 111*c* and 111*d*.

Similarly, the second heating element 112 includes heating sections 112*a*, electrodes 112*c* and 112*d*, and a conductive section 112*b* which connects the heating sections 112*a* to the electrodes 112*c* and 112*d* and connects the heating sections 112*a* to each other. The heating sections 112*a* generate heat when electric power is supplied through the electrodes 112*c* and 112*d*. Furthermore, the power supply is performed through power supply connectors 114 and 115. The first and second heating elements 111 and 112 are disposed on the ceramic substrate 110 which is in contact with an inner surface of the endless belt 102. The first and second heating elements 111 and 112 may be independently driven.

A line B illustrated in FIG. 2C represents a conveyance reference line for the sheet 21. The sheet 21 is conveyed such that a center of the sheet 21 in a width direction matches the line B. A region L1 represents a conveyance region for sheets having a predetermined maximum size set in the image forming apparatus, and a region L2 represents a conveyance region for sheets having a predetermined minimum size set in the image forming apparatus. The first heating element 111 is mainly used to heat the center portion of the sheet 21 in the width direction, and the second heating element 112 is used to heat end portions of the sheet 21. Specifically, heat distribution of the first heating element 111 and heat distribution of the second heating element 112 are different from each other. The endless belt 102 is heated by the first and second heating elements 111 and 112. Hereinafter, the first heating element 111 is also referred to as a "main heating element" and the second heating element 112 is also referred to as a "sub heating element".

Figure 3:
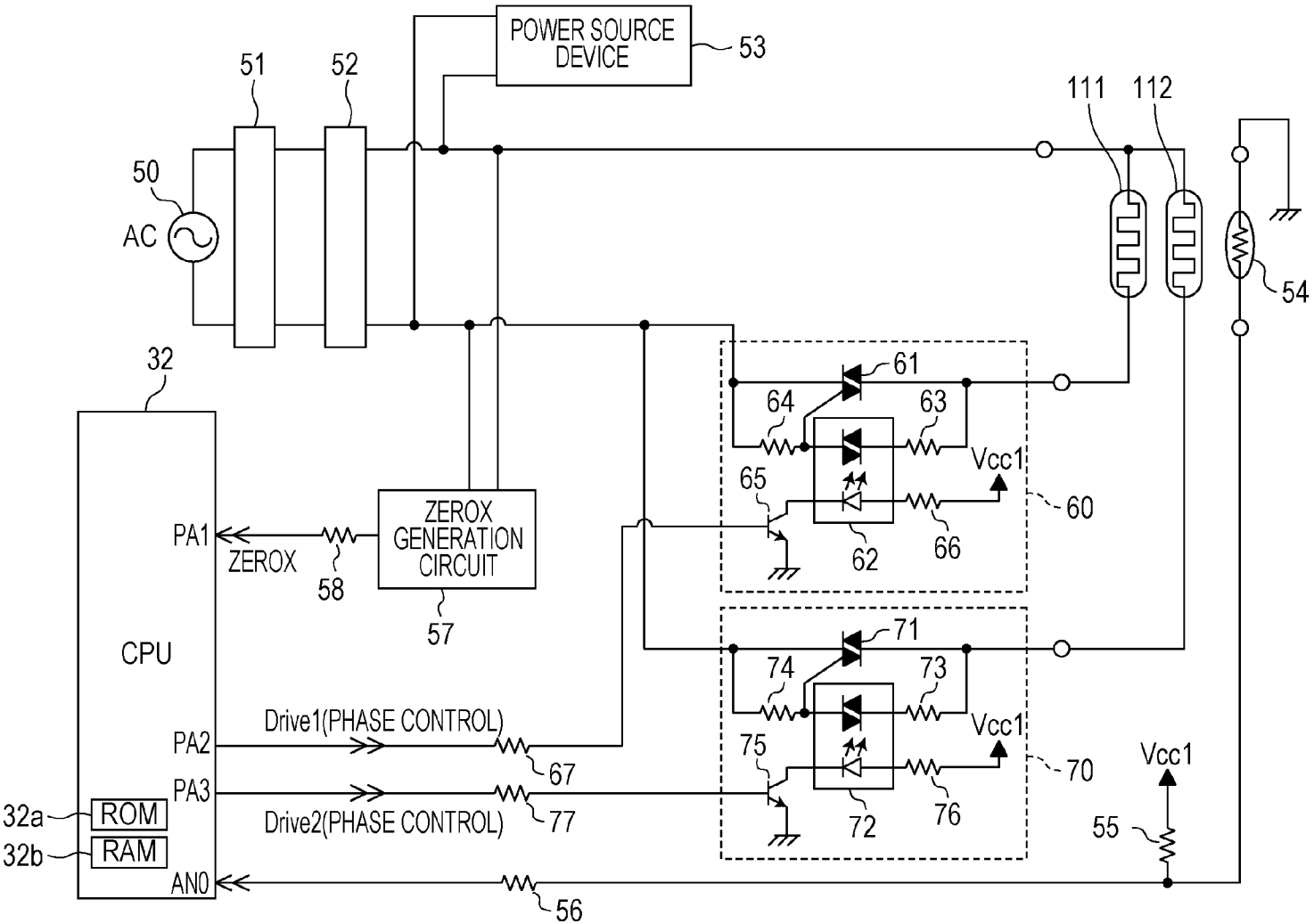
FIG. 3 is a diagram illustrating a power supply circuit and a power control circuit.

FIG. 3 is a diagram illustrating a power supply circuit and a power control circuit. A commercial power source (an AC power source) 50 supplies electric power to the image forming apparatus through an inlet 51. The power supply circuit includes a primary side which is directly connected to the commercial power source 50 and a secondary side which is connected to the commercial power source 50 in a noncontact manner through a transformer not illustrated which is included in a power source device 53. The heating elements 111 and 112 receive electric power from the commercial power source 50 through an AC filter 52. The power source device (a power source unit) 53 outputs a predetermined voltage (a voltage of 24V and a voltage of 3.3V) to a load on the secondary side. As described above, the heating elements 111 and 112 and the power source device 53 are disposed on the primary side of the power supply circuit. Furthermore, the photosensitive drums 13Y to 13K, the motor which drives the intermediate transfer belt 19 and the like, the CPU 32, and the like are disposed on the secondary side of the power supply circuit.

The CPU 32 executes heater driving control and the like. The CPU 32 includes input/output ports, the ROM 32*a*, and the RAM 32*b*. Reference numerals 60 and 70 represent phase control circuits (heater driving circuits). The first heater driving circuit 60 drives the first heating element 111 and is controlled in accordance with a signal supplied from the CPU 32. The second heater driving circuit 70 drives the second heating element 112 and is controlled in accordance with a signal supplied from the CPU 32.

A temperature of the heater 100 is monitored by a temperature detection element (a thermistor) 54. The temperature detection element 54 is used to detect a temperature of a region of the heater 100 in which a sheet of a minimum size which is usable by the image forming apparatus passes. The temperature detection element 54 has one terminal connected to the ground and the other terminal connected to an electrical resistance 55. The temperature detection element 54 is further connected to an analog input port AN0 of the CPU 32 through an electrical resistance 56. The temperature detection element 54 has a characteristic in which when the temperature detection element 54 is heated, a resistance value is lowered. The CPU 32 stores a temperature table (not illustrated), and detects a temperature of the heater 100 in accordance with divided voltages of a resistance of the temperature detection element 54 and the fixed electrical resistance 55.

Electric power output from the commercial power source 50 is supplied to a ZEROX generation circuit 57 through the AC filter 52. The ZEROX generation circuit 57 outputs a signal in a high level when a commercial power source voltage is equal to or smaller than a threshold value voltage set in the vicinity of a voltage of 0V, and otherwise outputs a signal in a low level. Thereafter, a pulse signal having a cycle substantially equal to a cycle of the commercial power source voltage is supplied through an electrical resistance 58 to a port PA1 of the CPU 32. The CPU 32 detects an edge of a ZEROX signal in which the ZEROX signal is changed from a high level to a low level, and uses the edge as a reference timing for driving the first and second heater driving circuits 60 and 70.

The CPU 32 determines a duty ratio Px of electric power to be supplied to the first heating element 111 and a duty ratio Py of electric power to be supplied to the second heating element 112 in accordance with the temperature detected by the temperature detection element 54 and a sheet size (a sheet width). Then the CPU 32 determines timings when the first and second heater driving circuits 60 and 70 are driven so that the electric power to be supplied to the first and second heating elements 111 and 112 attains the duty ratios Px and Py and outputs driving signals Drive1 and Drive2 from ports PA2 and PA3.

Next, the first phase control circuit 60 will be described. Since the second phase control circuit 70 is configured similarly to the first phase control circuit 60, a detailed description of the second phase control circuit 70 is omitted. When the output port PA2 (PA3) is brought to a high level at a timing determined by the CPU 32, a transistor 65 (75) is turned on through a base resistance 67 (77). When the transistor 65 (75) is turned on, a phototriac coupler 62 (72) is turned on. Note that the phototriac coupler 62 (72) is a device which ensures a creeping distance between the primary side and the secondary side. An electrical resistance 66 (76) is used to restrict current supplied to a light-emitting diode included in the phototriac coupler 62 (72).

Electrical resistances 63 (73) and 64 (74) are bias resistances for a triac 61 (71), and when the phototriac coupler 62 (72) is turned on, the triac 61 (71) is turned on. The triac 61 (71) maintains an on state after being turned on until an AC voltage reaches a next zerocross point. Accordingly, electric power is supplied to the main heating element 111 (the sub heating element 112) in accordance with a timing of the on state.

The CPU 32 is capable of changing a ratio (X:Y) of the duty ratio of the electric power to be supplied to the first heating element 111 to the duty ratio of the electric power to be supplied to the second heating element 112. In this embodiment, the ratio of the duty ratio of the electric power to be supplied to the main heating element 111 to the duty ratio of the electric power to be supplied to the sub heating element 112 is set in accordance with the width of the sheet 21. For example, when printing is performed on the sheet 21 having a width of L2 illustrated in FIG. 2C, electric power is supplied only to the main heating element 111. In this case, the ratio (X:Y) of the duty ratio of the electric power to be supplied to the main heating element 111 to the duty ratio of the electric power to be supplied to the sub heating element 112 is 100:0. Furthermore, when printing is performed on the sheet 21 having a width of L1, the ratio X:Y is 100:100. When printing is performed on the sheet 21 having a width smaller than the width L1 and larger than the width L2, the main heating element 111 and the sub heating element 112 are driven in an optimum ratio suitable for the width of the sheet 21. Since the ratio (X:Y) is set in accordance with the width of the sheet 21, a temperature of a sheet non-passing area is prevented from being increased while preferable fixing ability of a toner image is ensured.

In this embodiment, ratios (X:Y) of standard sizes are illustrated in Table 1. In Table 1, the term "lateral" represents a case where a sheet is conveyed such that a long side of the sheet is parallel to the fixing nip portion N (Long Edge Feed). In Table 1, the term "longitudinal" represents a case where a sheet is conveyed such that a short side of the sheet is parallel to the fixing nip portion N (Short Edge Feed).

TABLE 1

| Sheet Size | X:Y |
|---|---|
| A4 lateral, A3 longitudinal | 100:100 |
| LTR lateral, LDR longitudinal, B4 longitudinal, EXE lateral, B5 lateral | 100:50 |
| LTR longitudinal, LGL longitudinal | 100:10 |
| A4 longitudinal, A5 lateral, A6 longitudinal | 100:0 |

The ratio (X:Y) may be more finely set in accordance with a size of a sheet, and the ratio (X:Y) may be set in accordance with a value of a sheet width specified by a user or a sheet width measured by a sheet width detection unit, not illustrated, in a case of a sheet of an unstandardized size. Alternatively, a second temperature detection element which detects a temperature of edge portions in a longitudinal direction of the heater 100 (a sheet non-passing portion of a minimum size sheet) may be provided and the ratio (X:Y) may be set in accordance with the temperature detected by the second temperature detection element.

The CPU 32, first, calculates a duty ratio P (%) (=Duty Cycle) in accordance with a temperature detected by the temperature detection element 54. When the duty ratio P (%) and the ratio (X:Y) corresponding to a sheet size are determined, the CPU 32 calculates a duty ratio Px (%) of electric power to be supplied to the first heating element 111 and a duty ratio Py (%) of electric power to be supplied to the second heating element 112. The duty ratio Px is represented by the following expression: Px (%)=(X/Z)×P, and the duty ratio Py is represented by the following expression: Py (%)=(Y/Z)×P. Note that "Z" corresponds to a larger one of "X" and "Y".

Figure 4A:
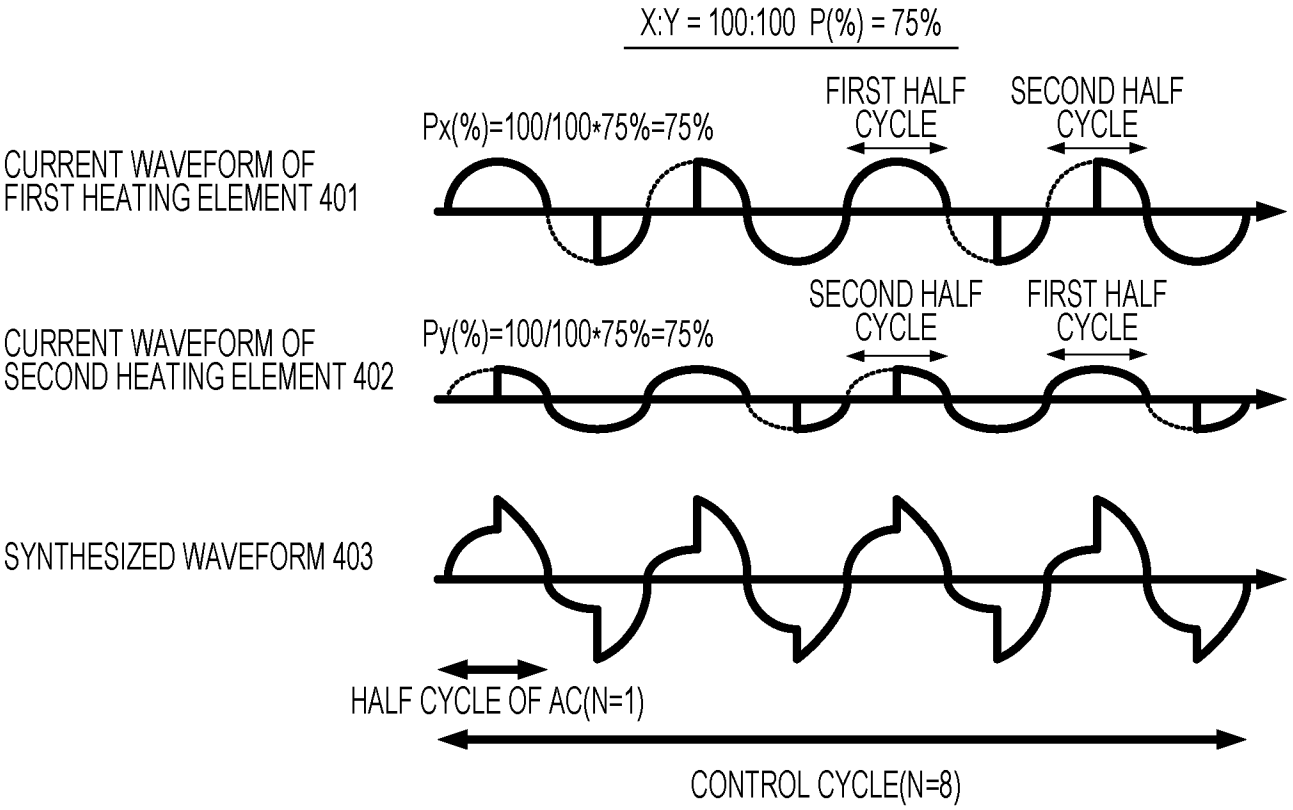
FIGS. 4A to 4C are diagrams illustrating control patterns according to a first embodiment.

FIG. 4A is a diagram illustrating waveforms of currents supplied to the main heating element 111 and the sub heating element 112 per control cycle obtained when the ratio (X:Y) is 100:100 and the duty ratio P is 75%, and a synthesized waveform of the currents.

As illustrated in FIG. 4A, the CPU 32 (an electric power controller) controls the electric power to be supplied to the first heating element 111 and the electric power to be supplied to the second heating element 112 for each control cycle in accordance with the temperature detected by the temperature detection element 54 while a plurality of consecutive half cycles of alternate current are set as the control cycle. In this embodiment, eight half cycles (four cycles) correspond to a control cycle. Assuming that a half cycle is represented by "N=1", "N=8" represents a control cycle. Furthermore, the control cycle includes half cycles in which current is supplied or not supplied in the entire half cycles of alternate current (which is referred to as "first half cycles") and half cycles in which current is supplied to portions of the half cycles of alternate current (which is referred to as "second half cycles") in a mixed manner. Specifically, the first half cycles in which current is supplied or not supplied in the entire half cycles of the alternate current and the second half cycles in which current is supplied in portions of the half cycles of the alternate current are mixed under control of the electric power controller.

Furthermore, the case of FIG. 4A, that is, the case where the ratio (X:Y) is 100:100 and the duty ratio P is 75% will be described. In this case, the electric power controller controls the electric power to be supplied to the first heating element 111 and the second heating element 112 such that the first half cycles and the second half cycles overlap with each other in the half cycles of the same phases of the alternate current supplied to the first heating element 111 and the alternate current supplied to the second heating element 112. This waveform is referred to as a "first control pattern". When the first half cycles and the second half cycles overlap with each other in the half cycles of the same phases of the alternate current supplied to the first heating element 111 and the alternate current supplied to the second heating element 112, a waveform of a total current becomes similar to a sine wave, and therefore, a power factor is improved and generation of a harmonic wave may be suppressed. When the power factor is improved, a maximum consumption current of the apparatus may be reduced.

The duty ratio P (%) of the electric power is calculated by the CPU 32 using PID control or the like in accordance with the temperature detected by the temperature detection element 54 and a target temperature set in advance. The duty ratio P (%) is set for individual control cycles in accordance with temperatures detected by the temperature detection element 54.

When the duty ratio P is 75% and the ratio (X:Y) is 100:100, Z is 100. Accordingly, electric power of the duty ratio Px of 75% (Px=100/100*75) is supplied to the main heating element 111. Furthermore, electric power of the duty ratio Py of 75% (Py=100/100*75) is supplied to the sub heating element 112. A waveform 401 represents a current supplied to the main heating element 111, a waveform 402 represents a current supplied to the sub heating element 112, and a waveform 403 represents a synthesized wave obtained by synthesizing the current supplied to the main heating element 111 and the current supplied to the sub heating element 112.

Figure 4B:
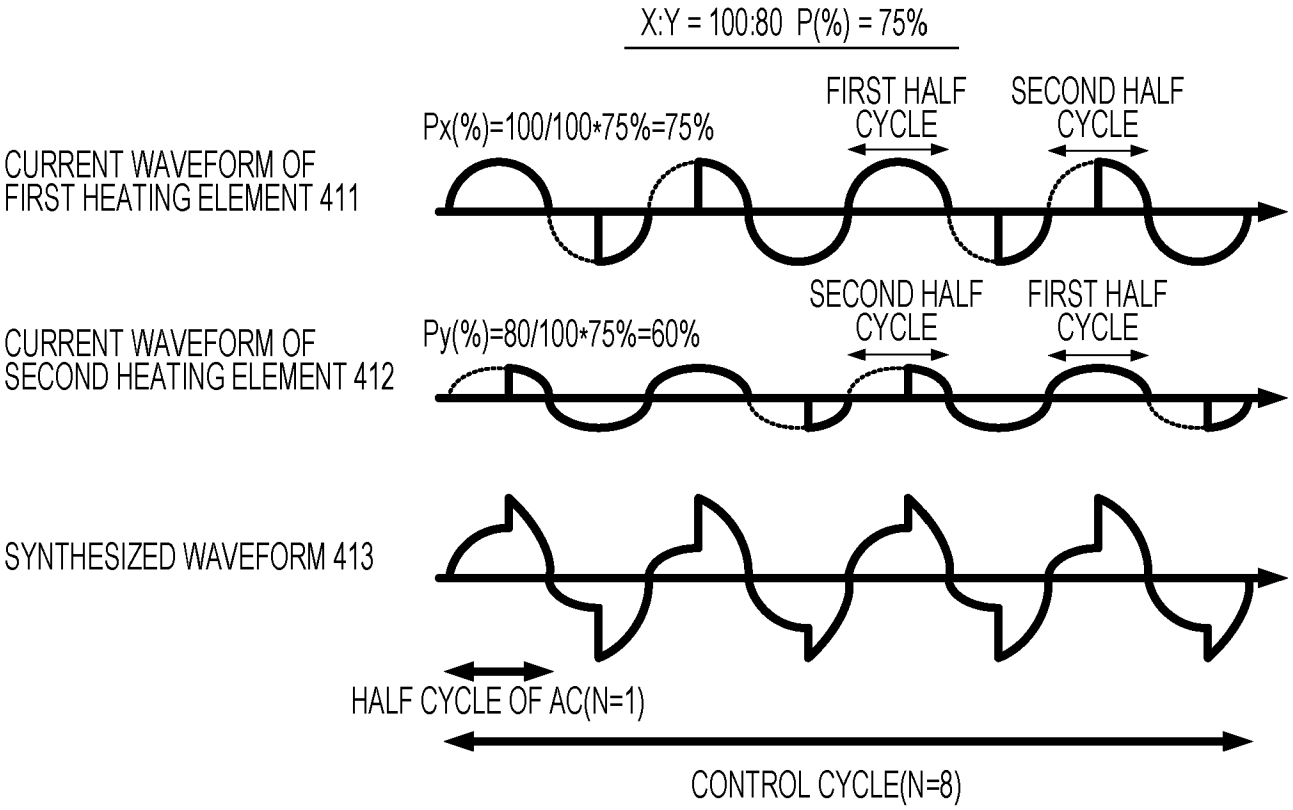

FIG. 4B is a diagram illustrating waveforms of currents supplied to the main heating element 111 and the sub heating element 112 in a control cycle when the ratio (X:Y) is 100:80 and the duty ratio P is 75%, and a synthesized waveform of the currents. In this case, electric power of the duty ratio Px of 75% (Px=100/100*75) is supplied to the main heating element 111, and electric power of the duty ratio Py of 60% (Py=80/100*75) is supplied to the second heating element 112. In this case also, the electric power controller controls the electric power to be supplied to the first heating element 111 and the second heating element 112 such that the first half cycles and the second half cycles overlap with each other in the half cycles of the same phases of the alternate current supplied to the first heating element 111 and the alternate current supplied to the second heating element 112. Specifically, control in a first control pattern is performed.

Figure 4C:
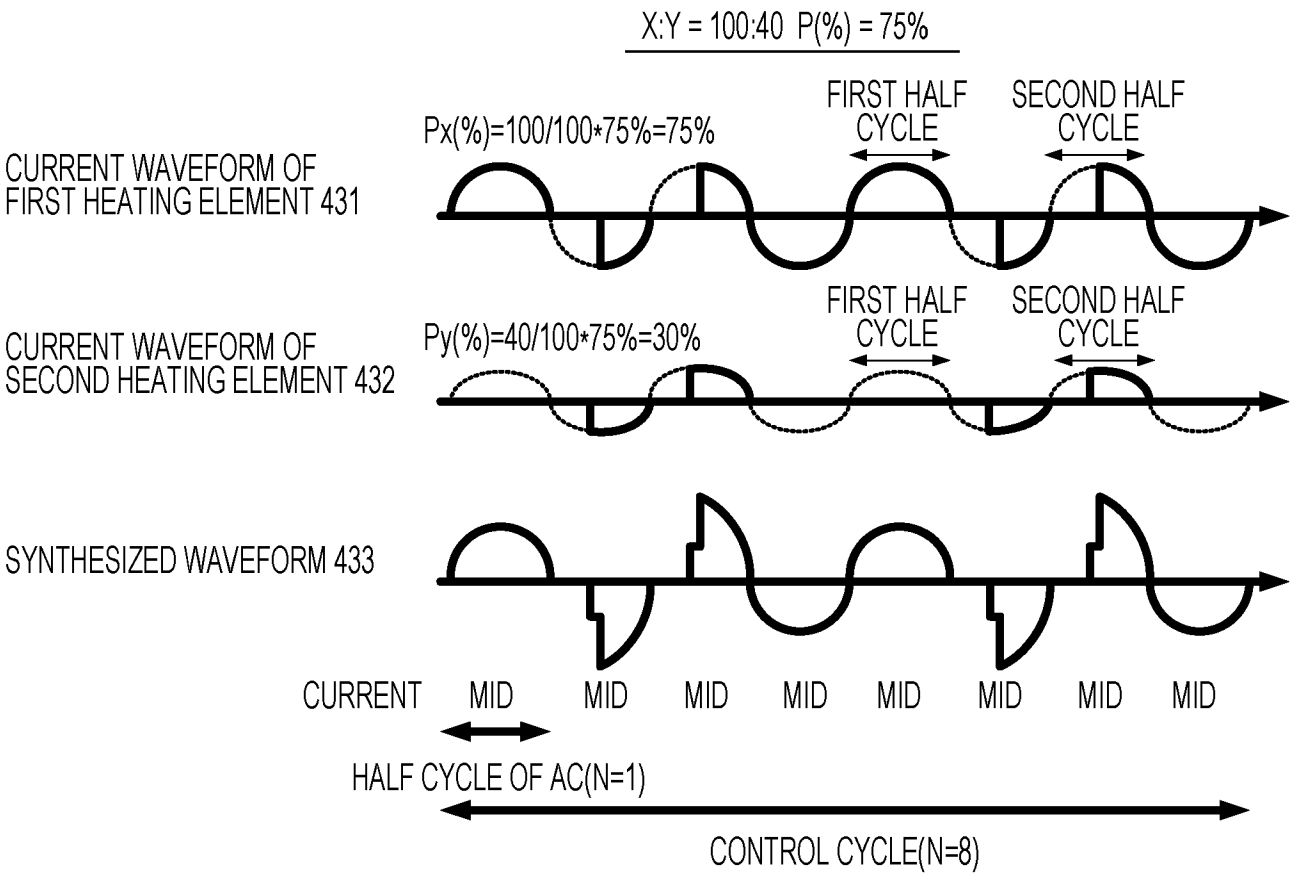

FIG. 4C is a diagram illustrating waveforms of currents supplied to the main heating element 111 and the sub heating element 112 in a control cycle when the ratio (X:Y) is 100:40 and the duty ratio P is 75%, a synthesized waveform of the currents, and magnitudes of a synthesized current in the individual half cycles. In this case, electric power of the duty ratio Px of 75% (Px=100/100*75) is supplied to the main heating element 111, and electric power of the duty ratio Py of 30% (Py=40/100*75) is supplied to the sub heating element 112. The waveforms illustrated in FIG. 4C are different from the waveforms illustrated in FIGS. 4A and 4B in some points. Specifically, in a case of the ratio (X:Y) of 100:40 and the duty ratio P of 75%, the electric power controller controls the electric power to be supplied to the first heating element 111 and the second heating element 112 such that first half cycles overlap with each other and second half cycles overlap with each other in the half cycles of the same phases. This waveform is referred to as a "second control pattern". A reason that the second control pattern is selected in the case of FIG. 4C instead of the first control pattern will be described below.

Figure 5:
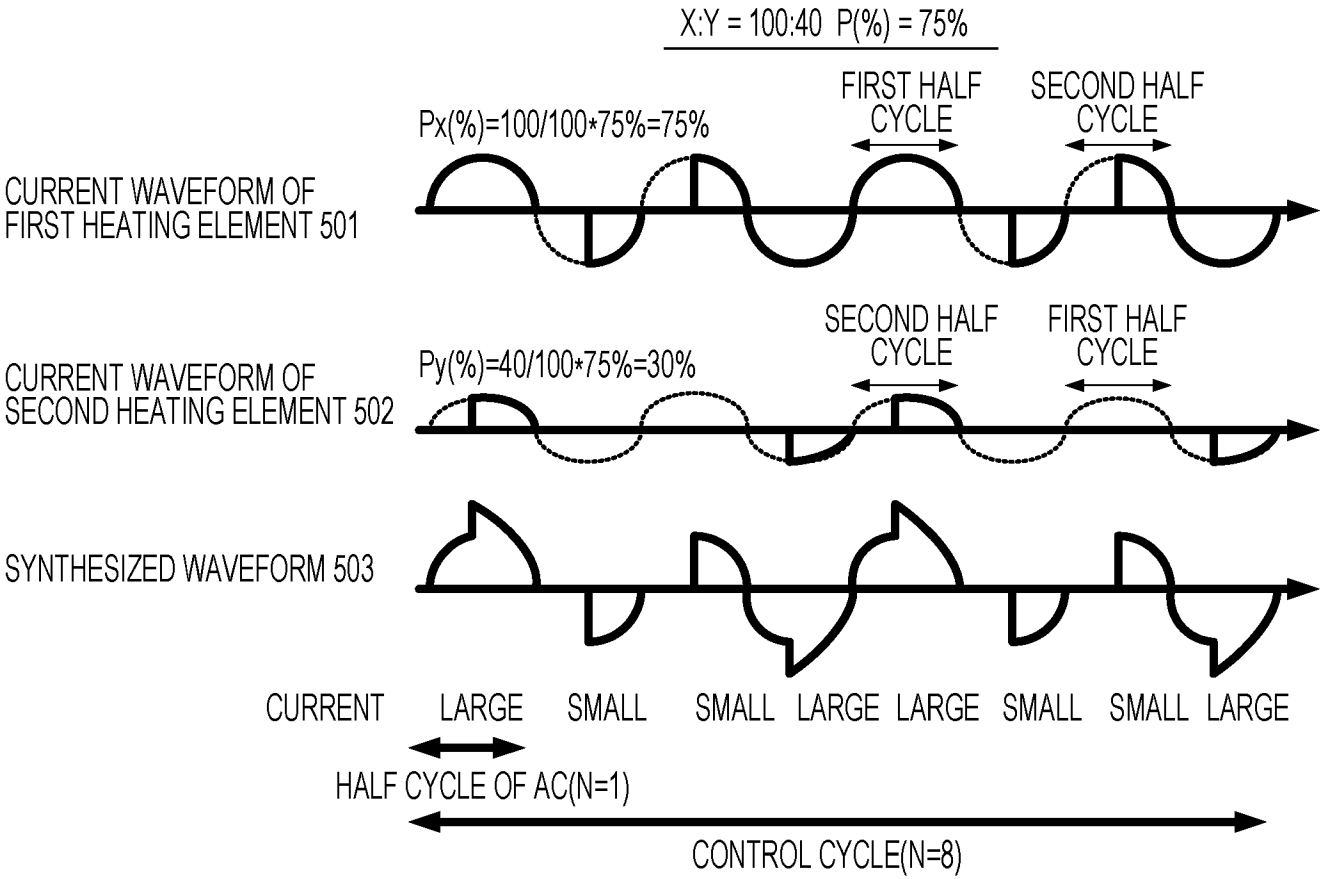
FIG. 5 is a diagram illustrating a control pattern according to a comparative example.

As with FIG. 4C, FIG. 5 is a diagram illustrating waveforms of currents supplied to the main heating element 111 and the sub heating element 112, a synthesized waveform of the currents, and magnitudes of a synthesized current in the individual half cycles in a control cycle when the ratio (X:Y) is 100:40 and the duty ratio P is 75%. However, as a control pattern, the first control pattern for controlling the electric power to be supplied to the first heating element 111 and the second heating element 112 such that the first half cycles overlap with the second half cycles in the half cycles of the same phases is employed. When the first control pattern is employed in the case of the ratio (X:Y) of 100:40 and the duty ratio P of 75%, a waveform 503 of a synthesized current is obtained. In this case, current is concentrated in half cycles N of 1, 4, 5, and 8, and differences between values of the current in the half cycles N of 1, 4, 5, and 8 and values of the current in the other half cycles become large. When the synthesized current has such a waveform, flicker is further generated.

Figure 6:
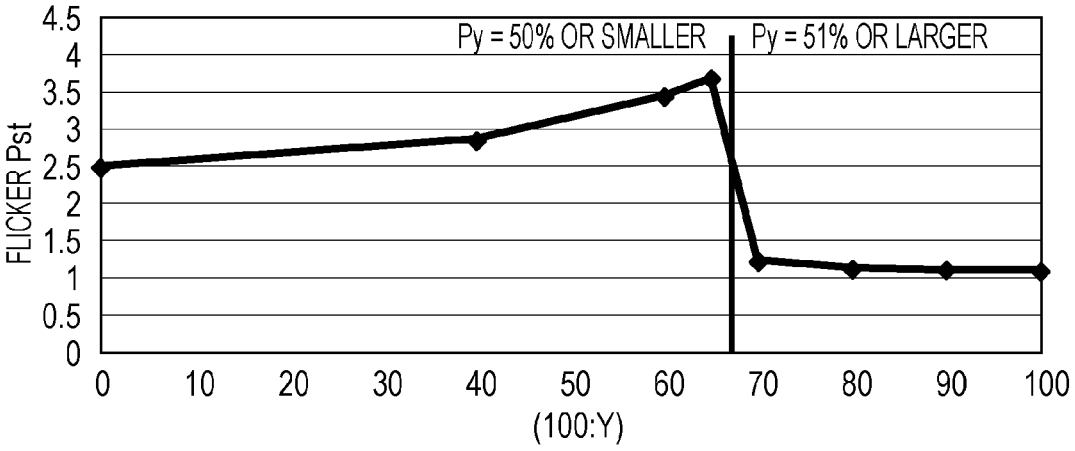
FIG. 6 is a graph illustrating the relationship between a lighting ratio and a flicker evaluation value.

FIG. 6 is a graph representing a flicker evaluation value Pst obtained when the duty ratio P (%) is fixed to 75%, an item Y of the ratio (X:Y) is changed while an item X of the ratio (X:Y) is fixed to 100, and electric power is supplied to the main heating element 111 and the sub heating element 112 by the first control pattern. An axis of abscissa denotes a value of the item Y. When a portion in the vicinity of the item Y of 66.6 is set as a boundary, a flicker value is suppressed in a range in which the item Y is larger than 66.6 and the flicker value is large in a range in which Y is smaller than 66.6. When the item Y is equal to 66.6, electric power of a duty ratio Px of approximately 75% (Px=100/100*75) is supplied to the main heating element 111 and electric power of a duty ratio Py of approximately 50% (Py=66.6/100*75) is supplied to the sub heating element 112. The reason that the result illustrated in FIG. 6 is obtained as the flicker value will be described hereinafter.

When the duty ratios Px and Py become smaller than 50%, a first half cycle in which current is not supplied is set in the control cycle. Furthermore, in a case of the first control pattern, a half cycle (of alternate current supplied to the other heating element) having a phase the same as that of the first half cycle in which current is not supplied correspond to a second half cycle in which current is supplied in a portion of the half cycle. A current value of a synthesized wave of the first half cycle in which current is not supplied and the second half cycle in which current is supplied in a portion of the half cycle is small as illustrated in FIG. 5. In FIG. 5, periods of time in which the current value of the synthesized wave is small is represented by "small".

On the other hand, when the duty ratios Px and Py become larger than 50%, a first half cycle in which current is supplied in an entire half cycle is set in the control cycle. In a case of the first control pattern, a half cycle having a phase the same as that of the first half cycle in which current is supplied in the entire half cycle corresponds to a second half cycle in which current is supplied in a portion of the half cycle. A current value of a synthesized wave of the first half cycle in which current is supplied in the entire half cycle and the second half cycle in which current is supplied in a portion of the half cycle is large as illustrated in FIG. 5. In FIG. 5, periods of time in which the current value of the synthesized wave is large is represented by "large".

As described above, when one of the duty ratios Px and Py is smaller than 50% and the other is larger than 50%, current is concentrated on some half cycles of the synthesized wave (half cycles represented by "large") and considerably small current is obtained in the other half cycles (half cycles represented by "small") as illustrated in FIG. 5. The waveform in which the half cycles corresponding to a current value of the synthesized wave represented by "large" and half cycles corresponding to a current value of the synthesized wave represented by "small" are mixed causes generation of a flicker.

On the other hand, when the waveform illustrated in FIG. 4C (the second control pattern) is employed, even though the duty ratio Px is 75%, that is, the duty ratio Px is equal to or larger than 51%, and the duty ratio Py is 30%, that is, the duty ratio Py is equal to or smaller than 50%, generation of a flicker is suppressed. This is because, as is apparent from a synthesized waveform 433 of current illustrated in FIG. 4C, when the second control pattern is employed, the number of half cycles in which a current value is concentrated is reduced in the half cycles N of 1 to 8, and the current values are substantially uniformed. In the example of FIG. 4C, current values of all the half cycles of the synthesized wave are represented by "middle", that is, the current values are not as large as the current values represented by "large" in FIG. 5 and not as small as the current values represented by "small" in FIG. 5.

However, when the second control pattern is employed, the power factor and the harmonic wave are deteriorated. Accordingly, the second control pattern is employed only in a case where one of the duty ratios Px and Py is smaller than 50% and the other is larger than 50%. Here, in a case where the second control pattern is preferably employed, even though the power factor is deteriorated, supplied power is low and a maximum consumption current is small, and accordingly, there arises no problem.

Figure 7:
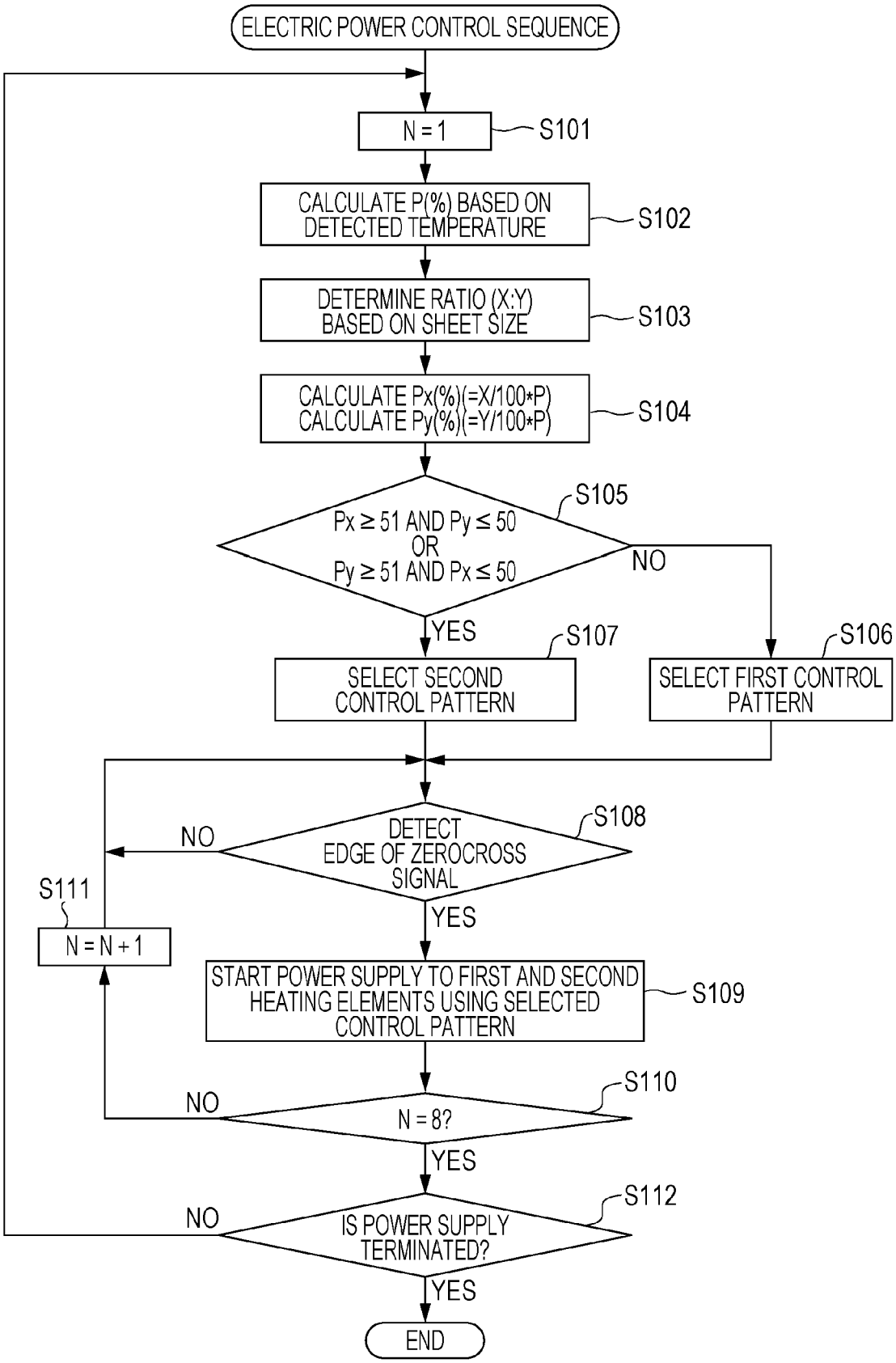
FIG. 7 is a flowchart illustrating a power control sequence according to the first embodiment.

FIG. 7 is a flowchart illustrating a power control sequence performed when Z is equal to 100. First, the CPU 32 performs an initial setting (S101), and calculates a duty ratio P (%) in accordance with a control target temperature and a temperature detected by the temperature detection element 54 (S102). Subsequently, the CPU 32 determines a ratio (X:Y) in accordance with a set sheet size (S103). Thereafter, a duty ratio Px (%) of electric power to be supplied to the main heating element 111 and a duty ratio Py (%) of electric power to be supplied to the sub heating element 112 are calculated in accordance with the duty ratio P (%) and the ratio (X:Y) (S104). In step S105, it is determined whether one of a determination as to whether the duty ratio Px is equal to or larger than 51% and the duty ratio Py is equal to or smaller than 50% and a determination as to whether the duty ratio Py is equal to or larger than 51% and the duty ratio Px is equal to or smaller than 50% represents a positive result. When the determination is negative, the first control pattern illustrated in FIG. 8A is selected (S106).

Subsequently, the CPU 32 detects a ZEROX signal (S108) and starts power supply (S109) at a timing when a rising edge or a falling edge of the ZEROX signal is detected. In step S109, power supply to the main heating element 111 and the sub heating element 112 is started using the duty ratio Px (%) and the duty ratio Py (%), respectively, in accordance with the first control pattern. It is determined whether N is equal to 8, that is, whether a control cycle is terminated in step S110. When the determination is negative, the CPU 32 increments N (5111). When N is equal to 8, a next power supply cycle (a next control cycle) is entered (the process returns from step S112 to step S101). When it is determined that the power supply is terminated in step S112, the power control sequence is terminated.

When the determination is affirmative in step S105, the second control pattern illustrated in FIG. 8B is selected (step S107). After step S108, power supply to the main heating element 111 and the sub heating element 112 is started using the duty ratio Px (%) and the duty ratio Py (%), respectively, in accordance with the second control pattern in step S109. The control performed hereafter is the same as that performed when the first control pattern is selected, and therefore, description thereof is omitted.

FIGS. 8A and 8B are diagrams illustrating control tables storing the first and second control patterns. Each of the first and second control patterns has a first heating element table and a second heating element table.

As described above, the CPU 32 (the electric power controller) selects the first control pattern or the second control pattern in accordance with the calculated duty ratios Px and Py. In FIGS. 8A and 8B, M1P to M4N and S1P to S4N denote half cycles of alternate current. Furthermore, numeric values of the half cycles represent duty ratios in periods of the half cycles. In the control tables illustrated in FIGS. 8A and 8B, the duty ratios of 11 levels from 0% to 100% with 10% increments in between are set. However, as illustrated in the case described with reference to FIGS. 4A to 4C, duty ratios of 21 levels with 5% increments in between (0%, 5%, 10%, 15%, . . . , 70%, 75%, 80%, 85%, 95%, and 100%) may be set. Alternatively, a larger number of levels may be more finely set.

As is apparent from the foregoing description, the case where the first control pattern is selected corresponds to the case where both of the duty ratios Px and Py are equal to or larger than 51% or the case where both of the duty ratios Px and Py are equal to or smaller than 50%. In the first control pattern illustrated in FIG. 8A, levels corresponding to the duty ratio Px of 51% or more (except for 100%) are compared with levels corresponding to the duty ratio Py of 51% or more (except for 100%), the first half cycles and the second half cycles overlap with each other in the half cycles of the same phases. Furthermore, levels corresponding to the duty ratio Px of 50% or less (except for 0%) are compared with levels corresponding to the duty ratio Py of 50% or less (except for 0%), the first half cycles and the second half cycles described above overlap with each other in the half cycles of the same phases.

On the other hand, the case where the second control pattern is selected corresponds to the case where the duty ratio Px is equal to or larger than 51% and the duty ratio Py is equal to or smaller than 50% or the case where the duty ratio Px is equal to or smaller than 50% and the duty ratio Py is equal to or larger than 51%. In the second control pattern illustrated in FIG. 8B, levels corresponding to the duty ratio Px of 51% or more (except for 100%) are compared with levels corresponding to the duty ratio Py of 51% or less (except for 0%). In this case, the first half cycles overlap with each other in half cycles of the same phases and the second half cycles described above overlap with each other in the other half cycles of the same phases. Furthermore, levels corresponding to the duty ratio Px of 50% or less (except for 0%) are compared with levels corresponding to the duty ratio Py of 51% or more (except for 100%). In this case, the first half cycles overlap with each other in half cycles of the same phases and the second half cycles overlap with each other in the other half cycles of the same phases.

As described above, in this embodiment, one of the first and second control patterns may be selected. Accordingly, an image heating device which supports a case where improvement of a power factor is preferentially performed and a case where suppression of a flicker is preferentially performed may be provided.

Furthermore, when both of the duty ratios Px and Py are larger than a threshold value or smaller than the threshold value, the power controller controls electric power such that the first half cycles and the second half cycles overlap with each other in the half cycles of the same phases of alternate current supplied to the first heating element 111 and alternate current supplied to the second heating element 112. Furthermore, When one of the duty ratios Px and Py is larger than the threshold value and the other is smaller than the threshold value, the power controller controls electric power such that the first half cycles overlap with each other and the second half cycles overlap with each other in the half cycles of the same phases. By this control, even in an apparatus which is required to change the ratio (X:Y), improvement of a power factor and suppression of generation of a flicker may be both attained.

Second Embodiment

In the first embodiment, the second control pattern is selected when a combination of the duty ratio Px (%) of electric power to be supplied to the main heating element 111 and the duty ratio Py (%) of electric power to be supplied to the sub heating element 112 satisfies a specific condition.

In a second embodiment, a determination as to whether a control pattern is to be changed is made by calculating electric power for each half cycle which is actually supplied to a main heating element and a sub heating element and further calculating variation of the electric power in a control cycle.

Figure 9:
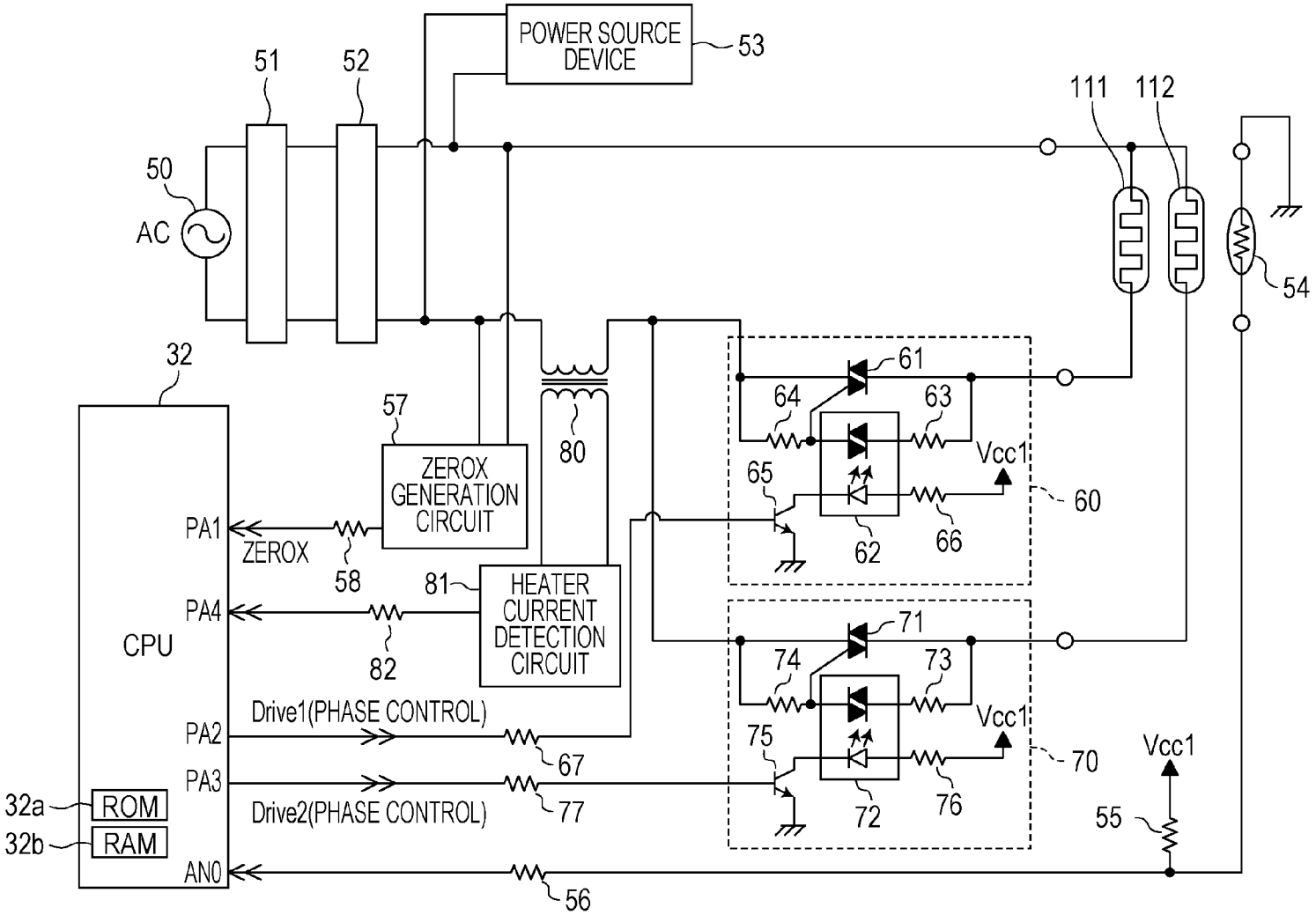
FIG. 9 is a diagram illustrating a power control circuit according to a second embodiment.

A power control circuit of this embodiment will be described with reference to FIG. 9. Current to be supplied to a first heating element 111 and a second heating element 112 is input to a heater current detection circuit 81 through a current transformer 80. The heater current detection circuit 81 performs voltage conversion on the input current. A current detection signal obtained by the voltage conversion is input to a port PA4 of a CPU 32 through an electrical resistance 82, subjected to A/D conversion, and managed as a digital value.

Figure 10:
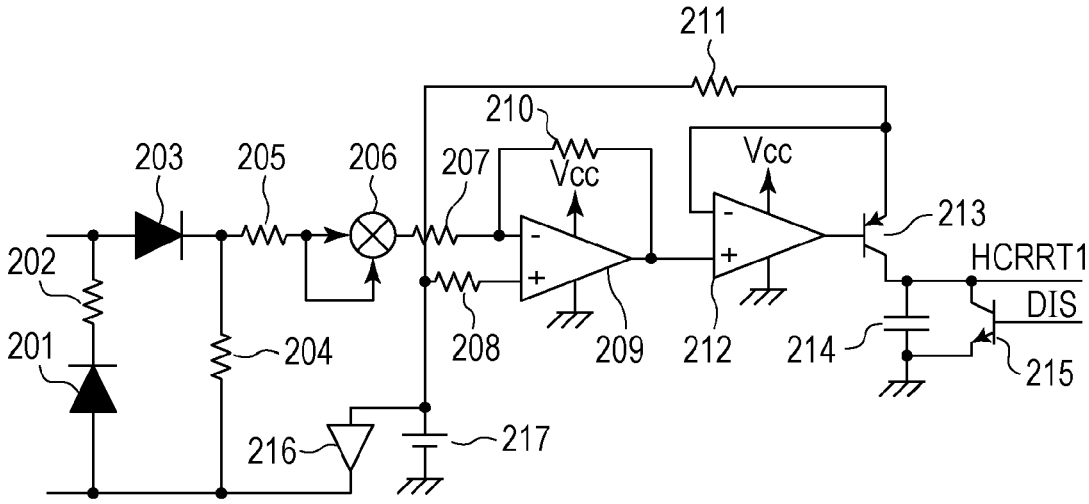
FIG. 10 is a diagram illustrating a current detection circuit.
Figure 11:
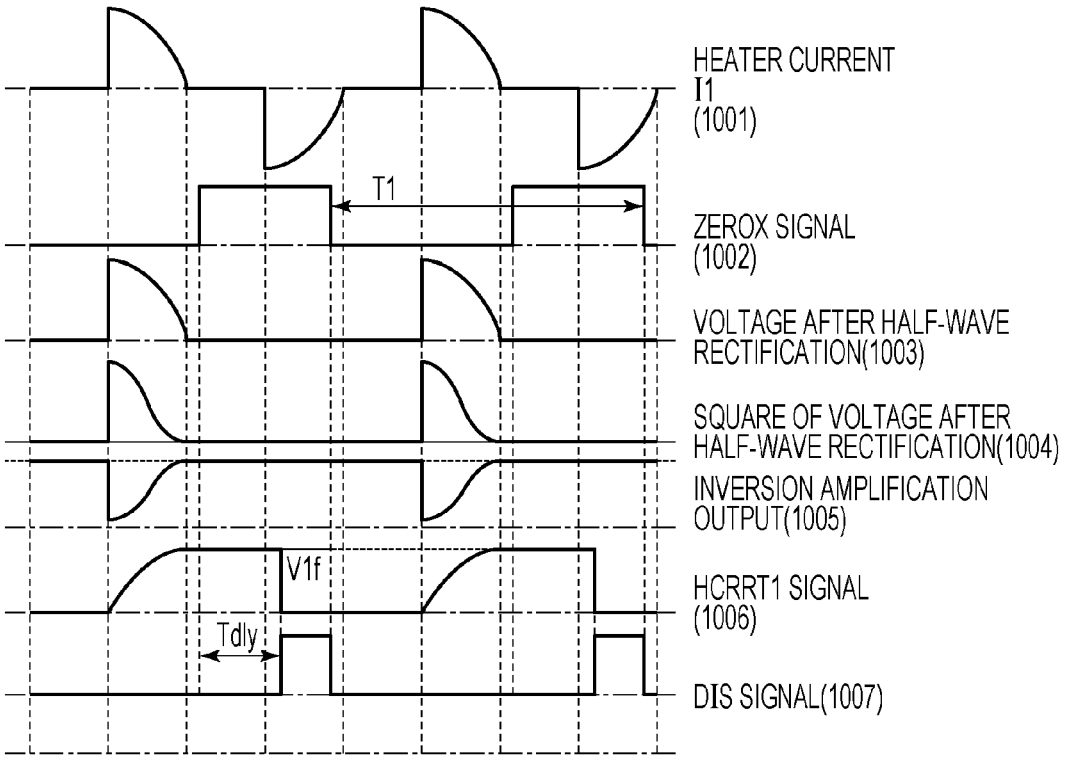
FIG. 11 is a diagram illustrating waveforms for current detection.

FIG. 10 is a block diagram illustrating a configuration of the heater current detection circuit 81 and FIG. 11 is a diagram of waveforms for explaining operation of the heater current detection circuit 81.

A current I 1001 of FIG. 11 is supplied to the first heating element 111 and the second heating element 112. The current transformer 80 performs voltage conversion on a current waveform of the current I1 on a secondary side. A voltage output from the current transformer 80 is rectified by diodes 201 and 203. Reference numerals 202 and 205 denote load resistances. A reference numeral 1003 of FIG. 11 represents a waveform obtained after half-wave rectification performed by the diode 203. The voltage waveform is input to a multiplier 206 through the resistance 205. The multiplier 206 outputs a square voltage waveform as denoted by a reference numeral 1004 of FIG. 11. The square waveform is input to a negative terminal of an operation amplifier 209 through a resistance 207. A reference voltage 217 is input to a positive terminal of the operation amplifier 209 through a resistance 208 and a feedback resistance 210 performs inversion amplification. The operation amplifier 209 receives voltage from a single power supply.

A reference numeral 1005 of FIG. 11 represents a waveform which has been subjected to the inversion amplification using the reference voltage 217 as a reference. An output from the operation amplifier 209 is supplied to a positive terminal of an operation amplifier 212. The operation amplifier 212 controls a transistor 213 such that a current determined by a voltage difference between the reference voltage 217 and a waveform input to the positive terminal of the operation amplifier 212 and a resistance 211 is supplied to a capacitor 214. By this, the capacitor 214 is charged by the current determined by the voltage difference between the reference voltage 217 and the waveform input to the positive terminal of the operation amplifier 212 and the resistance 211.

After a block of half wave rectification performed by the diode 203 is terminated, current to be supplied to the capacitor 214 for electric charge is stopped, and therefore, a voltage value is subjected to peak hold as denoted by a reference numeral 1006 of FIG. 11. Thereafter, as illustrated by a reference numeral 1007 in FIG. 11, a transistor 215 is turned on by a DIS signal in the half wave rectification period of the diode 201. By this, charged voltage of the capacitor 214 is discharged. The transistor 215 is turned on/off in accordance with the DIS signal supplied from the CPU 32 which performs on/off control of the transistor 215 on the basis of a ZEROX signal denoted by a reference numeral 1002. The DIS signal is turned on when a predetermined period of time Tdly is elapsed after a rising edge of the ZEROX signal 1002 and turned off at a timing of a falling edge of the ZEROX signal 1002 or immediately before the falling edge of the ZEROX signal 1002. By this, the control is performed without interfering electrification period of a heater 100 which corresponds to the half-wave rectification period of the diode 201.

Specifically, a peak hold voltage Vlf of the capacitor 214 corresponds to an integral value of a square value, corresponding to a half cycle, of a waveform obtained by performing voltage conversion on a current waveform by the current transformer 80 on the secondary side. The voltage value which has been subjected to the peak hold performed by the capacitor 214 is supplied from the heater current detection circuit 81 to the CPU 32 as an HCRRT1 signal 1006. The CPU 32 performs A/D conversion on the HCRRT1 signal 1006 input to a port PA4 for a period from the rising edge of the ZEROX signal 1002 to a certain point after Tdly. A heater current obtained by the A/D conversion corresponds to a heater current for a full wave (one cycle) of commercial power voltage. The CPU 32 averages heater currents of four full waves (four cycles) of commercial power voltage and multiplies a resultant value by a predetermined coefficient so as to calculate electric power to be consumed by the first heating element 111 and the second heating element 112. Note that a method for detecting current is not limited to this.

Next, a power measurement sequence based on current detection according to this embodiment will be described. This sequence is performed in an initial sequence or the like when a printer is turned on, for example. Furthermore, this sequence aims at calculating electric power supplied to the main heating element 111 and the sub heating element 112 while the duty ratios thereof are 100%.

Figure 12:
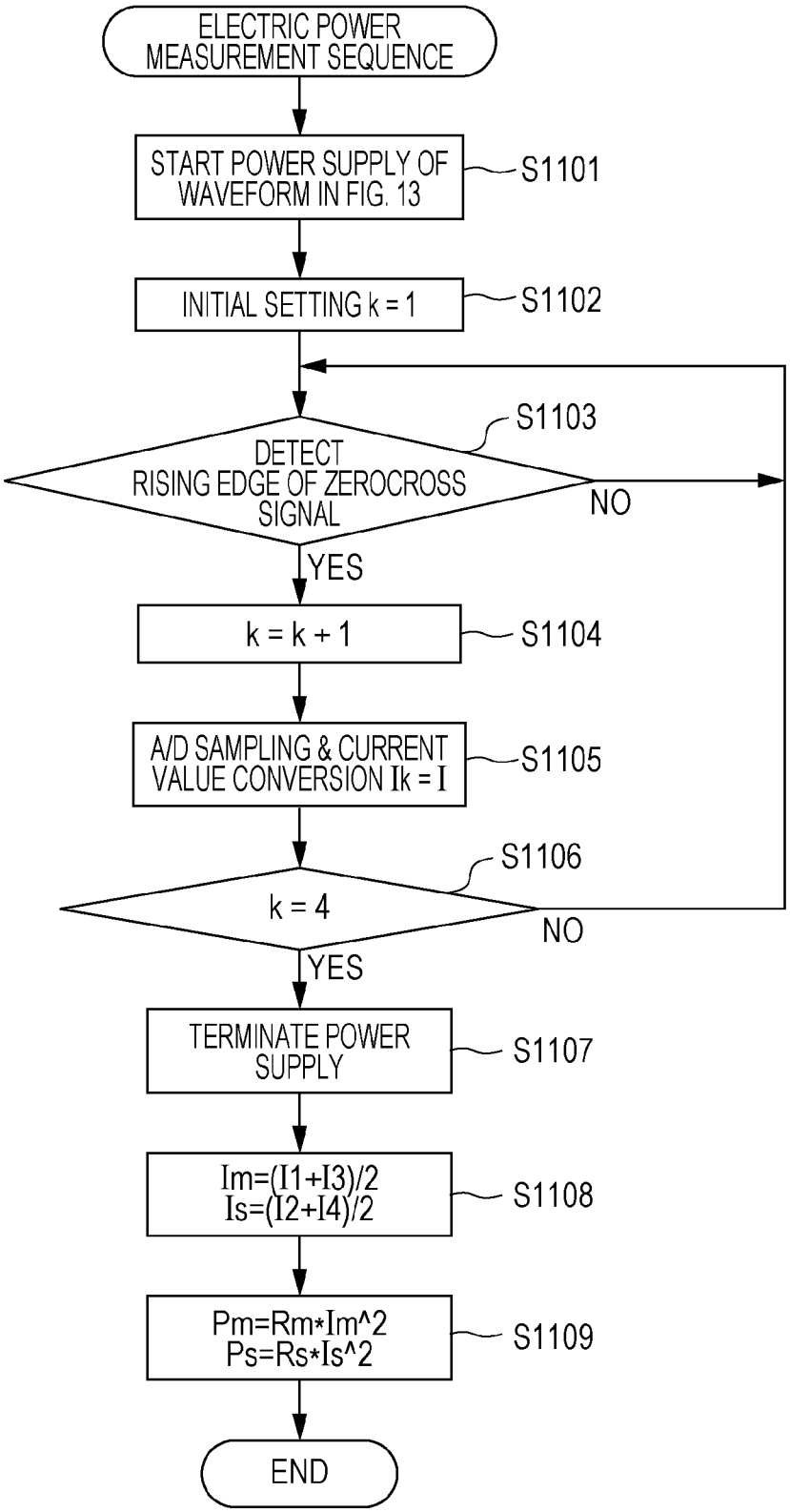
FIG. 12 is a flowchart illustrating a power measurement sequence according to the second embodiment.
Figure 13:
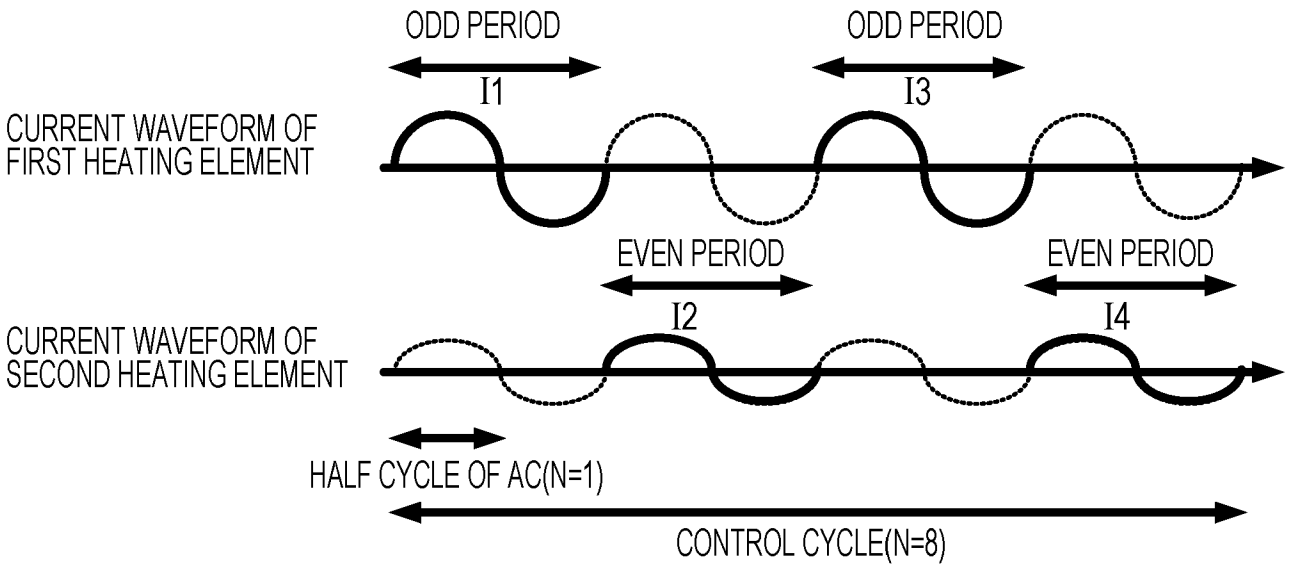
FIG. 13 is a diagram illustrating waveforms used at a time of current detection.

FIG. 12 is a flowchart illustrating the power measurement sequence. The flowchart in FIG. 12 will now be described. First, current measurement in four full waves (four cycles of alternate current) is performed. Therefore, in odd-numbered cycles of alternate current, driving is started while the duty ratio of the main heating element 111 is 100% and the duty ratio of the sub heating element 112 is 0%, whereas in even-numbered cycles, driving is started while the duty ratio of the main heating element 111 is 0% and the duty ratio of the sub heating element 112 is 100% (S1101). FIG. 13 is a diagram illustrating current waveforms of the main heating element 111 and the sub heating element 112 obtained when a current value is to be measured. The CPU 32 performs an initial setting in step S1102, and every time the CPU 32 detects a rising edge of the ZEROX signal 1002 (S1103), the CPU 32 increments k (S1104). The CPU 32 performs A/D sampling and current value conversion on an output of the heater current detection circuit 81 at a predetermined timing and "Ik=I" is set (S1105). When k is equal to 4 (S1106), power supply is terminated (S1107). Subsequently, the CPU 32 averages current values I1 and I3 in the odd-numbered cycles so as to calculate a current Im which is supplied to the main heating element 111, averages current values I2 and I4 in even-numbered cycles so as to calculate a current Is supplied to the sub heating element 112 (S1108). Finally, the CPU 32 calculates an electric power Pm used when power supply to the main heating element 111 is performed while the duty ratio is 100% in accordance with a predetermined resistance value Rm of the main heating element 111 and the current value Im of the main heating element 111 calculated in step S1108. Similarly, the CPU 32 calculates an electric power Ps used when power supply to the sub heating element 112 is performed while the duty ratio is 100% in accordance with a resistance value Rs of the sub heating element 112 and the current value Is of the sub heating element 112. Then this sequence is terminated. Although electric power used at a time when the main heating element 111 and the sub heating element 112 are driven in the duty ratios of 100% is calculated by measuring the heater current in this embodiment, electric power used at a time when the main heating element 111 and the sub heating element 112 are driven in the duty ratios of 100% by another method may be calculated.

As described above, in the second embodiment, a determination as to whether a control pattern is to be changed is made by calculating electric power of half cycles which are actually supplied to a main heating element and a sub heating element and further calculating variation of the electric power in a control cycle.

Figure 14A:
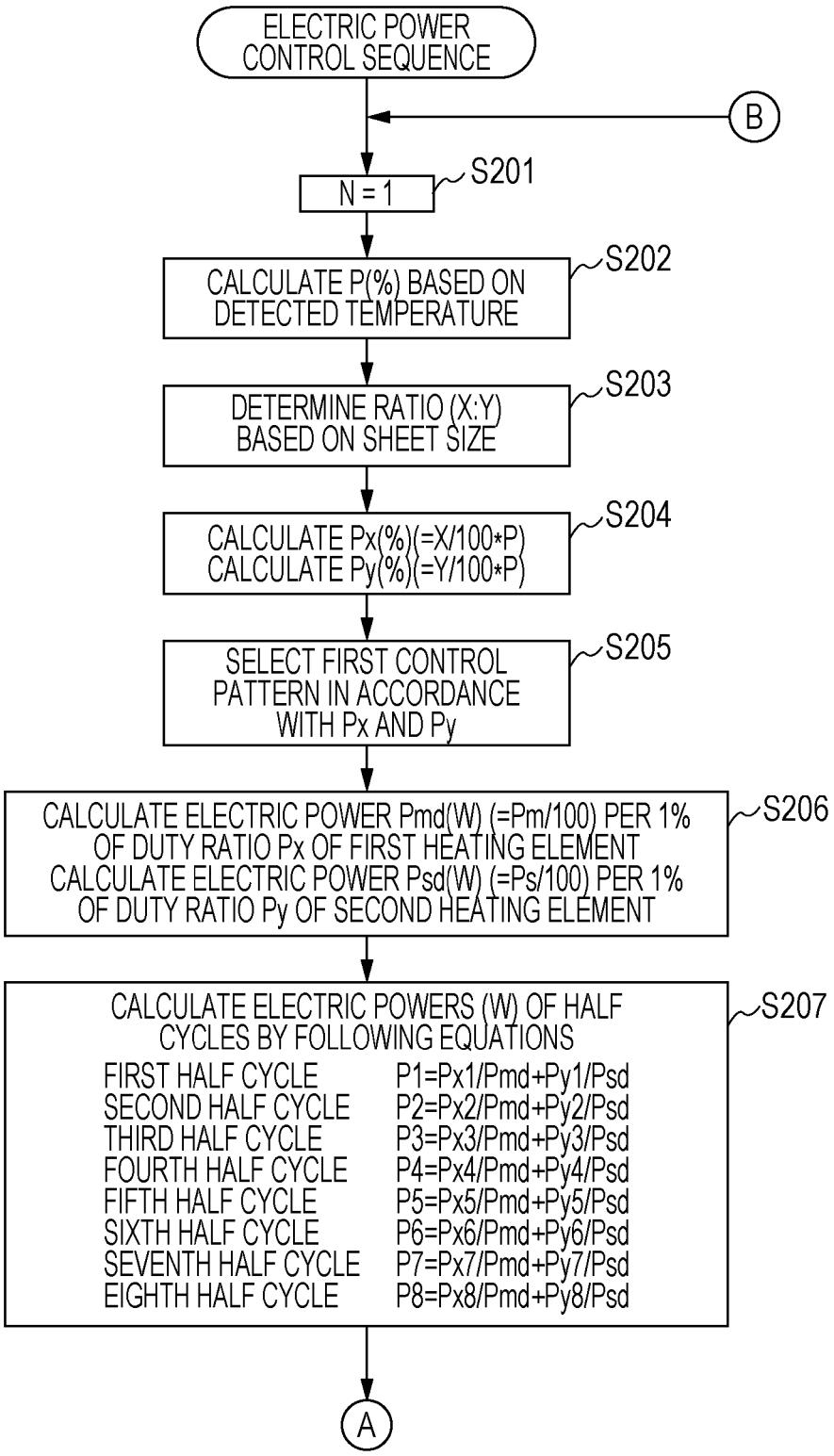
FIGS. 14A and 14B are a flowchart illustrating a power control sequence according to the second embodiment.
Figure 14B:
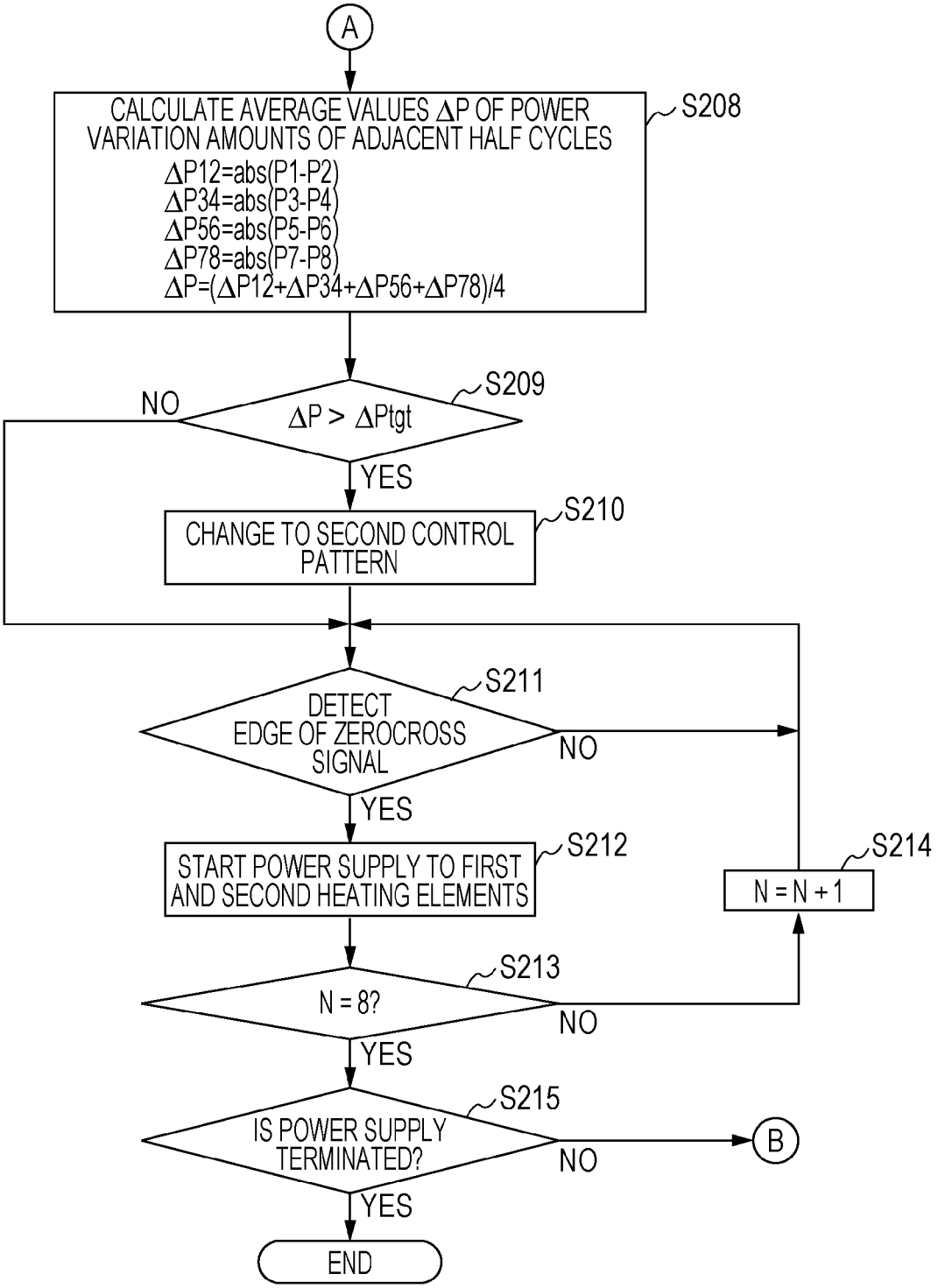

FIGS. 14A and 14B are a flowchart illustrating a power control sequence according to this embodiment. A process from step S201 to step S204 are the same as the process from step S102 to step S104 of the first embodiment, and therefore, a description thereof is omitted. In step S205, first, a waveform of a first control pattern, that is, a waveform in which first half cycles and second half cycles overlap with each other in the half cycles of the same phases of alternate current supplied to the first heating element 111 and alternate current supplied to the second heating element 112, is selected in accordance with duty ratios Px (%) and Py (%). Next, the CPU 32 calculates an electric power Pmd (W) corresponding to 1% of the duty ratio Px of the main heating element 111 and an electric power Psd (W) corresponding to 1% of the duty ratio Py of the sub heating element 112 (S206). Subsequently, the CPU 32 calculates electric powers (W) of half cycles in accordance with the control pattern selected in step S205 and the electric powers Pmd (W) and Psd (W) corresponding to 1% (S207) and calculates an average value ΔP of electric power variation amounts of adjacent half cycles (S208).

Next, the CPU 32 compares the average value ΔP of the electric power variation amounts and a predetermined electric power variation amount ΔPtgt corresponding to a situation in which a flicker is further generated so as to determine whether the control pattern is to be changed in step S209. Specifically, when power variation in adjacent half cycles is large, it is highly likely that a flicker is generated, and therefore, a second control pattern of the same duty ratios Px and Py is selected. A process from step S211 to step S215 is the same as the process from step S108 to step S112, and therefore, a description thereof is omitted.

As described above, also in this embodiment, the first control pattern or the second control pattern may be selected. Accordingly, an image heating device which supports a case where improvement of a power factor is preferentially performed and a case where suppression of a flicker is preferentially performed may be provided.

Furthermore, in this embodiment, a determination as to whether the control pattern is to be changed is made in accordance with a power variation amount between adjacent half cycles obtained in accordance with a current value of a detected current actually supplied to the heater. Specifically, the first control pattern or the second control pattern is selected in accordance with a variation amount obtained from sums of electric powers (W) of the first heating element 111 for individual half cycles and electric powers (W) of the second heating element 112 for individual half cycle in a control cycle. Accordingly, reliability of selection of a control pattern is improved when compared with the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-102396 filed May 14, 2013, which is hereby incorporated by reference herein in its entirety.

What is claimed is:

1. An image heating device comprising: a first heating element;

a second heating element configured to be driven independently from the first heating element;

a temperature detection element configured to detect a temperature; and an electric power controller configured to control electric power to be supplied to the first and second heating elements for each control cycle corresponding to a period including a plurality of consecutive hall cycles of alternate current in accordance with a temperature detected by the temperature detection element, wherein the electric power controller controls electric power such that a current is supplied to both the first and second heating elements, wherein the current includes a waveform having first half cycles, in which current is supplied or not supplied in entire half cycles of alternate current, and a second half cycle, in which current is supplied to portions of the half cycles of alternate current in a mixed manner, wherein the electric power controller sets a first control pattern in which electric power is controlled such that the first half cycle supplied to the first heating element and overlaps with the second half cycle supplied to the second heating element and in the half cycles of same phases, and the second half cycle supplied to the first heating element overlaps with the first half cycle supplied to the second heating element in the half cycles of the same phases during the control cycle; and wherein the electric power controller sets a second control pattern in which electric power is controlled such that the first half cycles supplied to the first and second heating elements overlap with each other and the second half cycles supplied to the first and second heating elements overlap with each other in the half cycles of the same phases during the control cycle.

2. The image heating device according to claim 1, wherein heat distribution of the first heating element and heat distribution of the second heating element are different from each other.

3. The image heating device according to claim 2, wherein the electric power controller is configured to changing a ratio (X:Y) of a duty ratio of electric power to be supplied to the first heating element to a duty ratio of electric power to be supplied to the second heating element, wherein a duty ratio of electric power to be set for each control cycle in accordance with a temperature detected by the temperature detection element is denoted by P (%), wherein a larger value between X and Y is denoted by Z, wherein the duty ratio of electric power to be supplied to the first heating element is denoted by Px (%)=(X/Z)×P (%), wherein the duty ratio of electric power to be supplied to the second heating element is denoted by Py (%)=(Y/Z)×P (%), and wherein, when both of the duty ratio Px and the duty ratio Py are larger than a threshold value or smaller than the threshold value, the electric power controller controls electric power to be supplied to the first and second heating elements by the first control pattern, and wherein, when one of the duty ratio Px and the duty ratio Py is larger than the threshold value and the other of the duty ratio Px and the duty ratio Py is smaller than the threshold value, the electric power controller controls electric power to be supplied to the first and second heating elements by the second control pattern.

4. The image heating device according to claim 2, wherein the electric power controller is configured to changing a ratio (X:Y) of a duty ratio of electric power to be supplied to the first heating element to a duty ratio of electric power to be supplied to the second heating element, and wherein the electric power controller selects one of the first and second control patterns in accordance with a variation amount of sums of electric powers (W1) of the first heating element and electric powers (W2) of the second heating element for individual half cycles in a period corresponding to the control cycle.

5. The image heating device according to claim 3, wherein the electric power controller sets the ratio (X:Y) in accordance with a size of a recording material.

6. The image heating device according to claim 4, wherein the electric power controller sets the ratio (X:Y) in accordance with a size of a recording material.

7. The image heating device according to claim 1, further comprising an endless belt which is heated by the first and second heating elements.

8. The image heating device according to claim 7, wherein the first and second heating elements are disposed on a substrate and constitute a heater that is in contact with an inner surface of the endless belt.

9. An image heating device comprising:

a first heating element;

a second heating element configured to be driven independently from the first heating element;

a temperature detection element configured to detect a temperature; and an electric power controller configured to control electric power to be supplied to the first and second heating elements for each control cycle corresponding to a period including a plurality of consecutive half cycles of alternate current in accordance with a temperature detected by the temperature detection element, wherein heat distribution of the first heating element and heat distribution of the second heating element are different from each other, wherein the electric power controller controls electric power such that a current is supplied to both the first and second heating elements, wherein the current includes a waveform having first half cycles, in which current is supplied or not supplied in entire half cycles of alternate current, and a second half cycle, in which current is supplied to portions of the half cycles of alternate current in a mixed manner, wherein the electric power controller sets a first control pattern in which electric power is controlled such that the first half cycle supplied to the first heating element overlaps with the second half cycle supplied to the second heating element in the half cycles of same phases, and the second half cycle supplied to the first heating element overlaps with the first half cycle supplied to the second heating element in the half cycles of the same phases, and sets a second control pattern in which electric power is controlled such that the first half cycles supplied to the first and second heating elements overlap with each other and the second half cycles supplied to the first and second heating elements overlap with each other in the half cycles of the same phases, and wherein the electric power controller is configured to changing a ratio (X:Y) of a duty ratio of electric power to be supplied to the first heating element to a duty ratio of electric power to be supplied to the second heating element, wherein a duty ratio of electric power to be set for each control cycle in accordance with a temperature detected by the temperature detection element is denoted by P (%), wherein a larger value between X and Y is denoted by Z, wherein the duty ratio of electric power to be supplied to the first heating element is denoted by Px (%)=(X/Z)×P (%), wherein the duty ratio of electric power to be supplied to the second heating element is denoted by Py (%)=(Y/Z)×F (%), and wherein, when both of the duty ratio Px and the duty ratio Py are larger than a threshold value or smaller than the threshold value, the electric power controller controls electric power to be supplied to the first and second heating elements by the first control pattern, and wherein, when one of the duty ratio Px and the duty ratio Py is larger than the threshold value and the other of the duty ratio Px and the duty ratio Py is smaller than the threshold value, the electric power controller controls electric power to be supplied to the first and second heating elements by the second control pattern.

10. The image heating device according to claim 9, wherein the electric power controller sets the ratio (X:Y) in accordance with a size of a recording material.

11. The image heating device according to claim 9, further comprising an endless belt which is heated by the first and second heating elements.

12. The image heating device according to claim 11, wherein the first and second heating elements are disposed on a substrate and constitute a heater that is in contact with an inner surface of the endless belt.

13. A method for an image heating device having a first heating element, a second heating element, a temperature detection element, and an electric power controller, the method comprising:

driving the second heating element independently from the first heating element;

detecting a temperature via the temperature detection element; and controlling, via the electric power controller, electric power to be supplied to the first and second heating elements for each control cycle corresponding to a period including a plurality of consecutive half cycles of alternate current in accordance with a temperature detected by the temperature detection element, wherein heat distribution of the first heating element and heat distribution of the second heating element are different from each other, wherein controlling electrical power includes controlling electric power such that a current is supplied to both the first and second heating elements, wherein the current includes a waveform having first half cycles, in which current is supplied or not supplied in entire half cycles of alternate current, and a second half cycle, in which current is supplied to portions of the half cycles of alternate current in a mixed manner, wherein controlling electrical power includes setting a first control pattern in which electric power is controlled such that the first half cycle supplied to the first heating element overlaps with the second half cycle supplied to the second heating element in the half cycles of same phases, and the second half cycle supplied to the first heating element overlaps with the first half cycle supplied to the second heating element in the half cycles of the same phases during the control cycle, wherein controlling electrical power includes setting a second control pattern in which electric power is controlled such that the first half cycles supplied to the first and second heating elements overlap with each other and the second half cycles supplied to the first and second heating elements overlap with each other in the half cycles of the same phases during the control cycle, wherein the electric power controller is configured to changing a ratio (X:Y) of a duty ratio of electric power to be supplied to the first heating element to a duty ratio of electric power to be supplied to the second heating element, wherein a duty ratio of electric power to be set for each control cycle in accordance with a temperature detected by the temperature detection element is denoted by P (%), wherein a larger value between X and Y is denoted by Z, wherein the duty ratio of electric power to be supplied to the first heating element is denoted by Px (%)=(X/Z)×P (%), wherein the duty ratio of electric power to be supplied to the second heating element is denoted by Py (%)=(Y/Z)×P (%), and wherein, when both of the duty ratio Px and the duty ratio Py are larger than a threshold value or smaller than the threshold value, controlling electric power via the electric power controller includes controlling electric power to be supplied to the first and second heating elements by the first control pattern, and wherein, when one of the duty ratio Px and the duty ratio Py is larger than the threshold value and the other of the duty ratio Px and the duty ratio Py is smaller than the threshold value, controlling electric power via the electric power controller includes controlling electric power to be supplied to the first and second heating elements by the second control pattern.

14. The method according to claim 13, wherein setting includes setting the ratio (X:Y) in accordance with a size of a recording material.

15. The method according to claim 13, further comprising heating an endless belt by the first and second heating elements.

16. The method according to claim 15, wherein the first and second heating elements are disposed on a substrate and constitute a heater that is in contact with an inner surface of the endless belt.

* * * * *